United States Patent [19]

Yamaguchi

[11] 4,143,994

[45] Mar. 13, 1979

[54] TURBINE HOUSING FOR CENTRIFUGAL TURBOSUPERCHARGER

[75] Inventor: Hiromasa Yamaguchi, Tokyo, Japan

[73] Assignee: Kabushiki Kaisha Komatsu Seisakusho, Tokyo, Japan

[21] Appl. No.: 792,984

[22] Filed: May 2, 1977

[30] Foreign Application Priority Data

Nov. 30, 1976 [JP] Japan ..... 51-159210

[51] Int. Cl.[2] ..... F01D 25/24

[52] U.S. Cl. ..... 415/205; 415/219 C; 60/605

[58] Field of Search ..... 415/205, 204, 219 C, 415/184; 60/605; 417/407

[56] References Cited

U.S. PATENT DOCUMENTS

| | | | |
|---|---|---|---|
| 3,218,029 | 11/1965 | Woollenweber | 415/205 X |
| 3,408,046 | 10/1968 | Woollenweber, Jr. | 415/184 |
| 3,614,259 | 10/1971 | Neff | 415/205 |
| 3,664,761 | 5/1972 | Zastrow | 415/205 |
| 3,930,747 | 1/1976 | Woollenweber | 415/205 |

*Primary Examiner*—Carlton R. Croyle
*Assistant Examiner*—Donald S. Holland
*Attorney, Agent, or Firm*—Armstrong, Nikaido, Marmelstein & Kubovcik

[57] ABSTRACT

A turbine housing for a centrifugal turbosupercharger comprising a spiral wall defining a gas passage through which exhaust gas from an engine passes and a partition wall dividing said gas passage into two passages wherein the height of the partition wall gradually decreases in the downstream direction. In such a manner that the gap between the outer periphery of a turbine rotor and the tip of the partition wall reaches a maximum at about 225° as measured from an intersection of the inner periphery of the partition wall and a line passing through the center of the turbine rotor and drawn perpendicular to the direction of introduction of exhaust gas.

1 Claim, 2 Drawing Figures

TURBINE HOUSING FOR CENTRIFUGAL TURBOSUPERCHARGER

BACKGROUND OF THE INVENTION

This invention relates to a turbine housing for use in a centrifugal turbosupercharger having a partition wall for dividing gas passage into two sections wherein the height of said partition wall decreases gradually in the downstream direction.

There has heretofore been known a vaneless turbine housing for use in centrifugal turbosuperchargers having a gas passage divided by a partition wall into two sections for minimizing the effect of pulsating flow. However, the above-mentioned conventional turbine housing is disadvantageous in that, because its gas passage is divided along the whole periphery of the turbine rotor, when a large pulsating flow occurs at the turbine inlet the partition wall functions effectively; however when a small pulsating flow occurs or there is no pulsating flow at the turbine inlet, the partition wall itself offers conversely a resistance to the gas flow so as to create friction losses, ect., thereby decreasing the performance of the turbine by about 5% as compared with ones without a partition wall. Further, in the case where a partition wall is formed along the whole periphery of the turbine rotor, casting fins or burrs tend to be formed at the tip of the partition wall during the manufacturing process. Therefore, if the fins or burrs were not removed completely during the manufacturing process, there was a fear that dropped fins or burrs, would enter the turbine rotor thereby damaging the rotor.

SUMMARY OF THE INVENTION

It is, therefore, an object of the present invention to provide a turbine housing for centrifugal turbosupercharger having a partition wall for a spriral gas passage wherein the height of the partition wall is gradually decreasing downstream.

Another object of the present invention is to provide a turbine housing for centrifugal turbosupercharger which can provide an excellent performance by minimizing the energy loss of exhaust gas due to its friction with the partition wall.

According to the present invention, there is provided a turbine housing for centrifugal turbosupercharger, comprising a spiral wall defining a gas passage through which exhaust gas from an engine passes, an inlet and an outlet for exhaust gas formed integrally with said spiral wall and a partition wall for dividing said gas passage into two sections wherein the height of said partition wall gradually decreases in the downstream direction in such a manner that the gap between the outer periphery of a turbine rotor and the tip of said partition wall reaches a maximum of about 225° as measured from an intersection of the inner periphery of the turbine rotor and a line passing through the centre of the partial wall and drawn perpendicular to a direction of gas to be introduced. Other objects, features and advantages of the present invention will be readily apparent from the following description taken in conjunction with the following drawings.

DETAILED DESCRIPTION OF THE INVENTION

Figure 1:
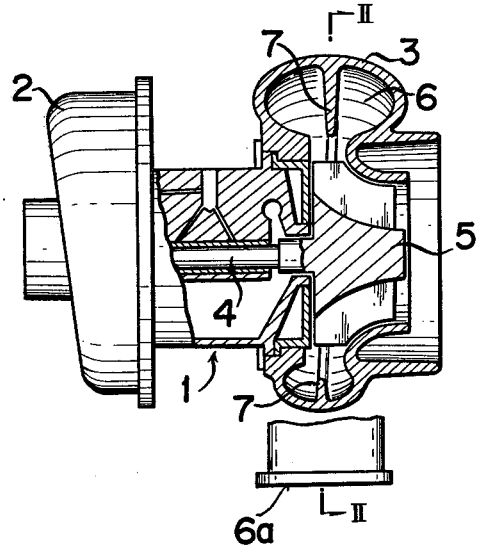
FIG. 1 is a side view partially in cross-section of a centrifugal turbosupercharger incorporating a turbine housing according to the present invention.
Figure 2:
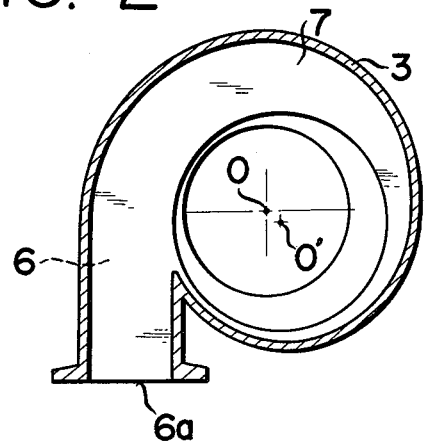
FIG. 2 is a cross-sectional view taken along the line II—II of FIG. 1.

The present invention will now be described in detail below by way of an embodiment with reference to the accompanying drawings. Reference numeral 1 denotes a centrifugal turbosupercharger having a compressor housing 2 and a turbine housing 3. The housings 2 and 3 accommodate a compressor rotor (not shown) and a turbine rotor 5 respectively, which are interconnected by a rotary shaft 4. Formed within the turbine housing 3 along the whole periphery of the turbine rotor 5 is a gas passage 6 having a gas inlet **6*a* formed in the lower part thereof. The gas passages 6 is divided into two sections by a partition wall 7 projecting circumferentially from the inner face of the turbine housing 3. The above-mentioned partition wall 7 divides the gas passage 6 completely into two sections at the gas inlet 6*a*. The height of the partition wall 7 decreases gradually from an intersection of the inner periphery of the partition wall 7 and a line passing through the centre of the turbine rotor 5 and drawn perpendicular to a direction of gas flow to be introduced, which is represented as reference point A in FIG. 2. As a means for gradually decreasing the height of the partition wall 7, as shown in FIG. 2, a centre O′ is set at a position offset obliquely and downwardly from a centre O of the turbine rotor 5, and a circle is drawn about the centre O′ which inscribes the inner surface of the turbine housing 3. In doing so, the partition wall 7** can be formed so as to reduce its height along the circle O′.

As mentioned in detail hereinabove, according to the present invention, the height of the partition wall 7 formed for dividing the gas passage 6 into two sections decreases gradually downstream so that the pulsating flow introduced through the gas inlet **6*a* is prevented from its damping due to interference by the partition wall near the gas inlet, and when a small pulsating flow occurs or there is no pulsating flow, the friction loss can be minimized by the action of the partition wall 7** having gradually reduced heights.

Therefore, as compared with the conventional turbine housing, according to the present invention, an excellent engine performance can be obtained at a rating point where the pulsating flow is relatively small, and also can be obtained at a maximum torque point where the pulsating flow is relatively large. Further, since the tip of the partition wall 7 is circular-arc shaped, casting fins or burrs formed in the partition wall can be removed easily by a machine tool, such as lathe. Therefore, the risk of the turbine rotor being damaged by dropped casting fins can be eliminated completely.

It is to be understood that the foregoing description is merely illustrative of the preferred embodiment of the invention and that the scope of the invention is not to be limited thereto, but is to be determined by the scope of the appended claims.

What is claimed is:

1. In a turbine housing for a centrifugal turbosupercharger including a spiral wall defining a gas passage through which exhaust gas from an engine passes, an inlet for exhaust gas formed integrally with said spiral wall, an outlet for exhaust gas formed integrally with said spiral wall and a partition wall for dividing said gas passage into two sections, said partition wall being formed integrally with said spiral wall wherein the improvement is characterised in that the height of said partition wall gradually decreases in the downstream direction in such a manner that the gap between the outer periphery of a turbine rotor and the tip of said partition wall reaches a maximum at about 225° as measured from an intersection of the inner periphery of the partition wall and a line passing through the centre of the turbine rotor and drawn perpendicular to the direction of introduction of exhaust gas.

* * * * *